US006240979B1

(12) United States Patent
Lorscheidt

(10) Patent No.: US 6,240,979 B1
(45) Date of Patent: Jun. 5, 2001

(54) DISPENSER, AND METHOD OF FILLING THE SAME

(75) Inventor: Willy Lorscheidt, Pulheim (DE)

(73) Assignee: RPC Wiko GmbH & Co. KG, Pulheim (DE)

( * ) Notice: Subject to any disclaimer, the term of this patent is extended or adjusted under 35 U.S.C. 154(b) by 0 days.

(21) Appl. No.: 09/528,293

(22) Filed: Mar. 17, 2000

Related U.S. Application Data

(63) Continuation of application No. PCT/EP98/06025, filed on Sep. 22, 1998.

(30) Foreign Application Priority Data

Sep. 23, 1997 (DE) ..... 197 41 957

(51) Int. Cl.[7] ..... B65B 1/04

(52) U.S. Cl. ..... 141/2; 141/18; 141/27; 222/321.7

(58) Field of Search ..... 141/2, 18, 25, 141/26, 27, 28; 53/473; 222/321.1, 321.6, 321.7, 321.8, 321.9

(56) References Cited

U.S. PATENT DOCUMENTS 4,694,977 9/1987 Graf et al. .
4,817,829 4/1989 Fuchs et al. .
5,217,050 * 6/1993 Varlet ..... 141/2
5,460,207 * 10/1995 Meshburg ..... 141/1

FOREIGN PATENT DOCUMENTS 0 263 995 A2 4/1988 (EP) .
0 408 421 A1 1/1991 (EP) .
0 668 082 4/1992 (EP) .
0 571 280 11/1993 (EP) .
0 679 443 A1 11/1995 (EP) .

* cited by examiner

*Primary Examiner*—Steven O. Douglas
(74) *Attorney, Agent, or Firm*—Laubscher & Laubscher

(57) ABSTRACT

The present disclosure relates to a method of filling a dispenser and to the dispenser itself. For already filling a defined part of the head piece (20) when mounting the dispenser after material has been filled into said dispenser and for ensuring an interruption-free dispensing behavior during future operation, it is suggested that, when a first point of airtight sealing of a fluid container (10) by means of a head piece (20) has been reached, the movement of the two elements towards one another should be continued along a predetermined, fixed displacement distance (X). In addition, a dispenser is provided, especially for carrying out the filling method, in which a bottom side of the head piece (20) and a filler opening of the fluid container (10), which is adapted to be coupled to said bottom side, are implemented such that they match.

8 Claims, 2 Drawing Sheets

Figure 1:
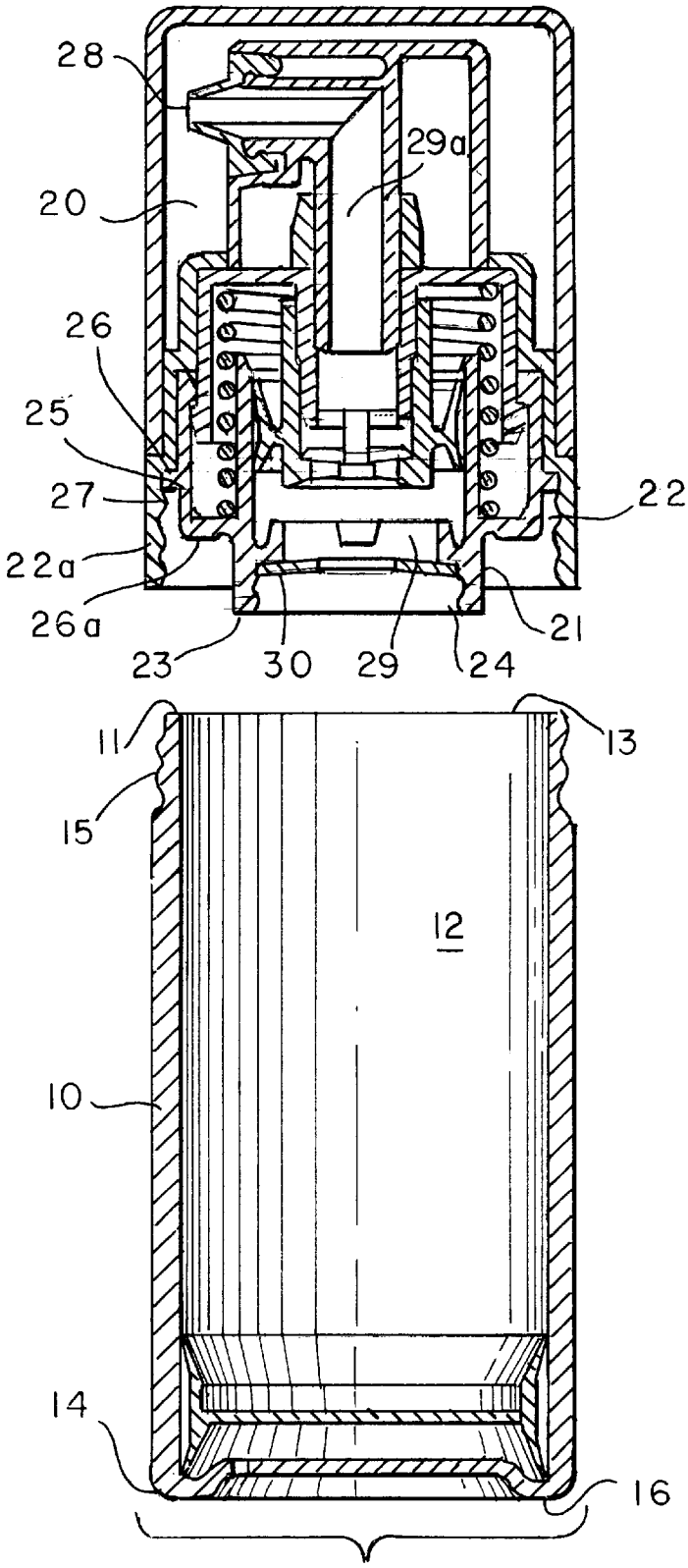

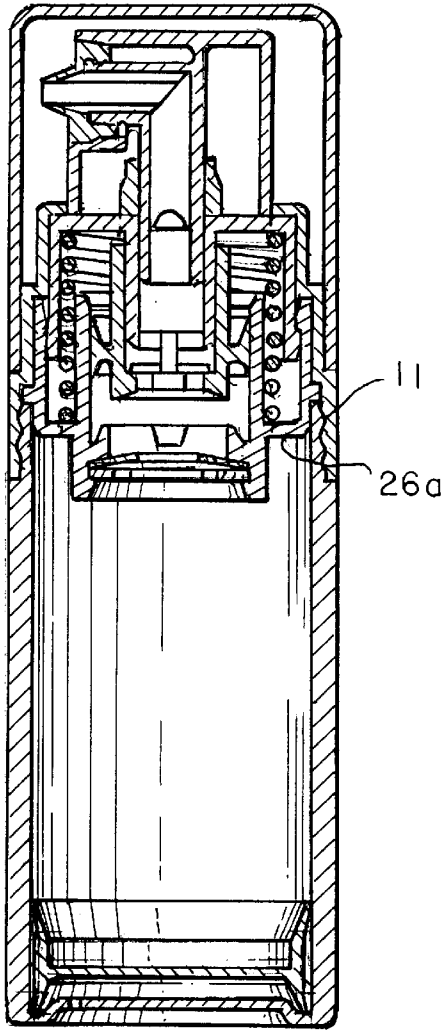
FIG. 3
FIG. 2
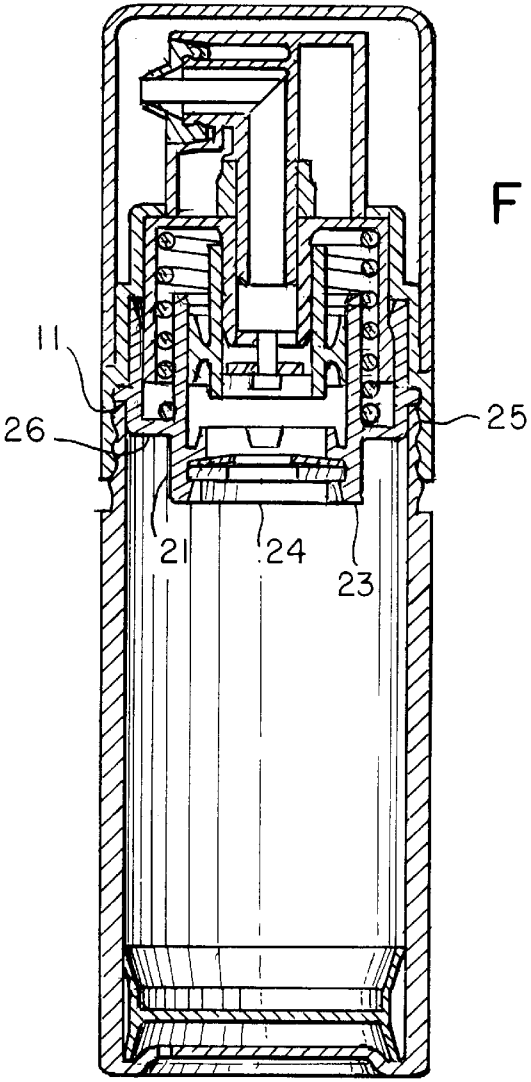

DISPENSER, AND METHOD OF FILLING THE SAME

REFERENCE TO RELATED APPLICATIONS

This application is a continuation application of PCT Application No. PCT/EP98/06025 filed Sep. 22, 1998, based on German priority application No. 197 41 957.7 filed Sep. 23, 1997.

The present invention relates to a method of filling a dispenser with a fluid to be dispensed, especially a pasty material, said dispenser comprising a head piece and a fluid container with a filler opening which is closed by said head piece when the fluid has been filled into the fluid container. The present invention additionaly relates to a fluid dispenser, in particular for pasty material, comprising a head piece which is attached to a fluid container thus closing a filler opening of said fluid container.

Dispensers of the above-mentioned type are suitable for dispensing flowable fluid media, including pastes.

In filling machines, which are used for filling a dispenser, filling tolerances occur and, as a consequence, slightly different filling levels in the storage container containing the medium in the dispenser. In the case of dispensers which are filled from the head side and then closed by the head piece containing the transport mechanism, air may remain in the storage chamber of the fluid container when the filling volume is at the lower limit of the tolerance range (minimum filling quantity); when the dispenser is used later on, this air may penetrate into a dispensing channel where it may cause interruptions in the flow of the medium to be dispensed. The user will feel this to be annoying, and in cases of use where a precise dosing behaviour is of essential importance, e.g. when the media dispensed are pharmaceutical products, these interruptions may cause substantial difficulties.

When the filling volumes are at the upper limit of the tolerance range (maximum filling quantity), the danger exists that, when the dispensing head is attached to the storage container, medium may be forced out either between the storage container and the dispensing head or through the dispensing head itself.

A method of filling a dispenser as well as a dispenser of the type cited at the start are known from EP-A-263 995. Overfilling of the storage container is there compensated by a deformation of a follow-up piston arranged in said storage container. When the filling volume is at the lower variation limit, air may, however, penetrate into a dispensing channel.

Since the follow-up piston of the known dispenser undergoes a change of shape in response to overfilling, it is, moreover, not possible to fill a defined space within the dispensing head with medium so that, e.g. in pumping dispensers, material will be dispensed only after several idle strokes.

Hence, it is the object of the present invention to improve a method and a fluid dispenser of the type cited at the start in such a way that, also with due regard to the filling tolerances of the filling machine, smooth filling of the dispenser resulting in improved functional properties thereof is achieved, and a dispenser is provided, which is more convenient to use.

In the case of a method cited at the start, the present invention solves this task by the features that, when the head piece is being attached to a fluid container, a projecting area of said head piece will first come into sealing contact with the fluid and that, when airtight sealing of a storage chamber of the fluid container has been established by the head piece and when said head piece is pushed onto the fluid container still further by a predetermined displacement distance for moving said head piece to an end position on the fluid container, fluid will be displaced from said fluid container into a discharge channel of the head piece.

When the head piece is being attached, a projecting area of said head piece first comes into contact with the medium in the fluid container and dives into said medium. Until the point of airtight sealing between the head piece and the fluid container is reached, air, which is located on top of the material to be dispensed, will be displaced from the storage container. Due to the fact that the movement of the head piece is continued and due to the predetermined fixed displacement distance, the content of the fluid chamber, (preferably a pasty mass) is compressed. Fluid can thus be pressed into a pump chamber and into the fluid dispensing channel of the head piece; said fluid does, however, not reach the dispensing opening of the fluid dispensing channel. By purposefully dimensioning the displacement distance and the resultant volume displacement in a pumping dispenser, the pump chamber and, if desired, also part of a downstream discharge channel following said pump chamber and leading to the dispensing outlet can be filled with fluid for the first time in this way, so that a controlled amount of fluid can already be dispensed by the first dispensing stroke or a dispensing stroke following the first one according to a preferred embodiment of the present invention. The displacement distance is chosen such that a fluid inlet opening of the head piece, which is adapted to be connected to the dispensing outlet, will always remain immersed in the fluid.

For compensating filling tolerances of a filling device and for guaranteeing continuous dispensing of the dispenser, a filling level is adjusted in the fluid container during filling of said container in such a way that the volume which will be displaced when the head piece is attached lies between a predeterminable maximum value and a minimum value until the point of first airtight sealing has been reached. Overfilling on the one hand and inclusions of air in the head piece on the other will be avoided in this way.

Further preferred embodiments of the method according to the present invention are disclosed in the associated subclaims.

According to the present invention, the task stated hereinbefore with regard to the dispenser is solved in the case of a dispenser of the type cited at the start by the features that the head piece is provided with a tubular chimney portion which projects into a storage chamber of the fluid container and the fluid displacement volume of which corresponds at least to a volume of a pump chamber of the head piece.

This structural design ensures not only a compensation of filling tolerances of the filling machines but also a reliable prefilling of a defined part of the discharge channel in the head piece including a transport means, such as a pump chamber. In addition, air is prevented from penetrating into the discharge channel of the head piece and squeezing out of fluid from the dispenser when the dispensing head is being attached is avoided as well.

In accordance with a preferred embodiment of the dispenser, an annular groove for accommodating a container wall of the fluid container is provided on the bottom side of the head piece, said container wall surrounding the filler opening and the groove depth of said annular groove corresponding at least to the predeterminable displacement distance when seen in relation to the position of an upper edge of this container wall when the point of airtight sealing has been reached for the first time and at an end position existing when the dispenser has been fully mounted. This permits a structurally simple solution for achieving the predeterminable displacement distance. The annular groove and the upper edge fulfil simultaneously the function of sealing the fluid chamber and allow a displacement of the head piece relative to the fluid container beyond the point of first airtight sealing of the storage chamber up to and into the locked end position of the head piece on the fluid container.

A locking device for securing the end position is provided perferably between the head piece and the fluid container. This locking device can be provided in the area of the upper edge on the one hand and the annular groove on the other, where it can be produced in a particulary simple manner, and it can be implemented e.g. as a snap-in connection. On the one hand, this snap-in connection fulfils a fastening function and, on the other hand, it will secure the head piece in position on the fluid container in the fully mounted condition of the dispenser, i.e. at the end position of the fully mounted head piece.

Instead of securing the head piece in position on the fluid container via the snap-in connection, said head piece can also be secured in position with the aid of an axial stop means of the annular groove on which the upper edge of the fluid container abuts at the end position. In this case, the displacement distance is defined by the depth of the annular groove. The fastening device between the head piece and the fluid container can, for example, also be implemented as a screw connection which will permit particualry simple refilling of the storage container when said container is empty.

In the following, the present invention will be explained in detail on the basis of an embodiment and an associated drawing, in which:

FIG. 1 shows a fluid container and a head piece of a dispenser before these components are mounted and after the filling of the fluid container, FIG. 2 shows the dispenser in a partially mounted condition, the head piece being pushed partially onto the fluid container, at the beginning of airtight sealing of a fluid chamber of the fluid container, and FIG. 3 shows the dispenser in the fully mounted condition, the head piece occupying an end position on the fluid container.

Making reference to FIG. 1, the structural design of a dispenser 1 according to the embodiment will be described in the following. The dispenser 1 consists of a fluid container 10 for accommodating a pasty material to be dispensed and of a head piece 20.

The fluid container 10 defines a hollow cylinder having a filler opening 11 at the top end (facing the head piece 20); through said filler opening 11 a storage chamber 12, which is provided in the interior of the fluid container 10, can be filled. At the bottom, the fluid container 10 is delimited by a bottom wall 16. The cross-section of the filler opening 11 corresponds to the cross-section of the storage chamber 12 so that a follow-up piston 14 can be inserted into the fluid container through said filler opening 11. In the area of the filler opening 11, a fastening section 13 is provided on the outer wall of the fluid container 10, said fastening section 13 being used for providing a snap-in connection with the head piece 20. This fastening section 13 is here implemented as a snap-in connection, but it my also be implemented as a thread.

In the present embodiment the head piece 20 is provided with a pumping head comprising a pump chamber 29 delimited by two check valves. The head piece 20 is provided with a bottom wall 22 on the side facing the fluid container 10, a tubular chimney portion protruding as a projection 21 from said bottom wall 22. In the direction of the fluid container 10, the projection 21 ends in an end wall 23 provided with a fluid inlet opening 24.

This fluid inlet opening 24 communicates with a downstream pump chamber 29 which, in turn, is connected to a fluid discharge channel 29*a* interconnecting the pump chamber 29 and an outlet opening 28 of the head piece 20.

Furthermore, an annular groove 25 is defined on the bottom side with an outer sleeve 22*a* of the head piece 20, said annular groove 25 being delimited by a snap-in contour 27 of the pumping head in the radial direction. In the installed condition of the dispenser (cf. FIG. 3), this annular groove 25 is in engagement with an upper edge 13 of an upper wall section of the fluid container 10, said upper edge 13 extending around the filler opening 11. In addition, the fastening section 27 of the head piece 20 is in engagement with the fastening section 13 of the fluid container. Instead of the snap-in connection shown in the embodiment, the fastening device 15, 27 can also be implemented as a screw connection; in this case, a groove bottom 26 of the annular groove 25 serves as a stop means.

Making reference to FIGS. 1 to 3, it will be explained hereinbelow how the dispenser is filled. After insertion of the follow-up piston 14 in the fluid container 10, a pasty material to be dispensed is filled into the storage chamber 12 of the fluid container 10 by means of a filling device. The volume to be filled into the storage chamber is adjusted on the filling device. This volume is calculated on the basis of the geometrical characteristics of the fluid container 10 including the follow-up piston 14 and a desired filling level in the storage chamber 12. Due to filling tolerances of the filling device, the filling level in the fluid container 10 will vary between a minimum filling level $A_1$ and a maximum filling level $A_2$.

When the fluid container 10 has been filled, the head piece 20 is attached thereto, as can be seen in FIGS. 2 and 3. FIG. 2 shows a condition in which the dispenser has been partially mounted and in which airtight sealing between the head piece 20 and the fluid container 10 is achieved for the first time. The sealing effect is guaranteed by a predetermined position of engagement between the fastening section 27 of the head piece 20 and the fastening section 15 of the fluid container 10; simultaneously an interior contact begins between the upper edge 13 of the fluid container 10, which delimits the filler opening 11, and a cup-shaped inner section 26*a* of the head piece 20. Before this point of first airtight sealing is reached, a tubular chimney portion (projection 21) or rather the end wall 23 thereof comes into contact with the pasty material in the fluid container 10 so that this material will be displaced by said projection 21 until the storage chamber 12 is closed by the head piece 20 in an airtight manner for the first time, and air which is present between the head piece 20 and the fluid container 10 will be forced out through the snap-in connection 15, 27. For this purpose, suitable means, e.g. grooves, are provided on the fastening device 15, 27. Due to the displacement of fluid caused by the tubular projection when the head piece 20 is being attached, the filling level will rise, as can be seen in FIG. 2, and reach, depending on the first filling level, the filling level B shown in FIG. 2, when the point of first airtight sealing is reached. When the fluid container 10 is filled with a filling volume at the lower tolerance limit, the minimum filling level B1 will be obtained in FIG. 2, the level of the medium on the outer side, i.e. radially around the projection 21, being higher than the plane in which the opening 24 provided on the projection 21 extends. The distance ΔB to the opening edge 13 of the storage container is a maximum, as can be seen in the left half of FIG. 2. The right half of FIG. 2 shows the maximum filling level B2 which is reached when a filling level at the upper variation limit of the filling device has been filled into the fluid container. The distance ΔB between the level and the opening edge 13 will then be a minimum. The displacement volume of the projection 21 is dimensioned such that the minimum distance ΔB becomes very small, ideally zero, i.e. all the air contained in the storage chamber 12 will be displaced when airtight sealing effected for the first time. As long as ΔB remains smaller than or equal to zero, no medium will be squeezed out of the dispenser.

When the point of airtight sealing has been reached for the first time, the head piece 20 and the fluid container 10 are moved towards each other still further for arriving at the end position, i.e. the fully mounted condition of the dispenser, shown in FIG. 3. In the course of this movement, the two elements are displaced relative to one another by the displacement distance X, whereby the opening edge 13 will be caused to penetrate into the annular groove 25 still further. Due to the airtight sealing, the content of the storage chamber is compressed in the course of this movement. In response to the increase in pressure in the fluid container 10, medium will be pressed into the head piece 20. In view of the predetermined displacement by the fixed distance X, the head piece 20 is filled with a precisely definable volume of medium. In the embodiment shown, this defined volume is chosen such that the displacement by said distance X will have the effect that a pump chamber 29 in the head piece 20 is filled so that an amount of medium defined by the piston stroke can already be dispensed when medium is being dispensed for the first time.

The flow resistance for pressing medium through the opening 24 in the direction of the outlet opening of the head piece 20 is chosen such that hardly any medium will penetrate into the head piece 20 until the point of airtight sealing has been reached so that a rise of the level of the medium in the fluid container 10 outside of the projection 21 and the resultant forcing out of residual air from the container are made possible. On the other hand, the flow resistance is chosen such that, when the point of airtight sealing has been reached, medium can penetrate into the head piece 20 when the displacement by said distance X takes place, without any movement or substantial deformation of the follow-up piston 14 being caused. In the embodiment shown, this flow resistance is determined by the elasticity of a valve 30 which is arranged above the opening 24 at a short distance therefrom and which is here implemented as a check valve ending in the pump chamber 29. For achieving a uniform lowering of the level around the projection 21, the check valve 30 is implemented point-symmetrically to the axial direction of the dispenser and concentrically with an axially extending central axis of the dispenser.

As can be seen from FIG. 3, the opening 24 always remains immersed in the medium when a displacement by said distance X takes place so that, when the medium is dispensed subsequently, air which may perhaps still be contained in the storage chamber cannot penetrate into the dispensing channel of the head piece 20. Even if the fluid container is filled with a filling volume at the lower variation limit, a mimimum filling level C1 will be reached at the end position, said minimum filling level C1 permitting a constant contact of the opening 24 with the medium. When the filling volume is a filling volume at the upper variation limit, the maximum filling level C2 will be reached.

In order to achieve reliable filling of a defined part, especially the pump chamber and the discharge channel of the head piece 20, the filling volume to be adjusted on the filling device or rather a target filling level to be achieved in the fluid container 10 is determined in dependence upon the filling volume variation of the filling device, the cross-section of the fluid container and the position of the opening 24. In order to prevent air from penetrating, the height L of the projection 21 is chosen such that said projection will come into contact with the medium in the storage chamber 12 before the point of airtight sealing is reached for the first time. The height L is limited by the volume displaced by the projection 21 when said projection dives into the medium, since otherwise medium will be squeezed out between the fluid container 10 and the head piece 20 before the point of airtight sealing has been reached for the first time. On the basis of a predetermined shape of the head piece 20 and the fluid container 10, the filling level to be adjusted on the filling device is additionally determined in dependence upon the displacement distance X and also in dependence upon the viscosity of the medium.

What is claimed is:

1. A method of filling a dispenser with a fluid to be dispensed, especially a pasty material, said dispenser comprising a head piece (20) and a fluid container (10) with a filler opening (11) which is closed by said head piece (20) when the fluid has been filled into the fluid container (10), wherein, when airtight sealing of a storage chamber (12) of the fluid container (10) has been established by the head piece (20) and when said head piece (20) is pushed onto the fluid container (10) still further by a predetermined displacement distance (X) for moving said head piece (20) to an end position on the fluid container (10), fluid will be displaced by the head piece (20) from said fluid container (10) into a discharge channel of the head piece (20), characterized in that, when the head piece (20) is being attached to the fluid container (10), a tubular projecting area (21) of said head piece (20) will first come into sealing contact with the fluid and that, when airtight sealing of the fluid container has been established, the fluid is exclusively contained in a storage chamber (12).

2. A method according to claim 1, characterized in that, before the point of airtight sealing between the head piece (20) and the fluid container (10) is reached, air is displaced from the fluid container (10) by the fluid acted upon by the projecting area (21) of the head piece (20).

3. A method according to claim 1 characterized in that the displacement distance (X) defines a sealing distance via which, in response to further pushing-on of the head piece (20) onto the fluid container (10), the fluid, including a residual air volume, is acted upon by pressure and displaced into the discharge channel.

4. A method according to claim 1 characterized in that, in connection with the pushing on of the head piece (20) and the locking of said head piece (20) at its end position on the fluid container (10), the fluid is displaced into a pump chamber (29) of the head piece (20) at least in such a way that said pump chamber is filled completely, and that especially also part of a fluid discharge channel is filled with said fluid, said fluid discharge channel extending from the pump chamber (29).

5. A method according to claim 1 characterized in that, when the fluid container (10) is being filled, a filling level (A) in said fluid container (10) is chosen in dependence upon a filling volume tolerance and a displacement volume of the projecting area (21) of the head piece (20).

6. A fluid dispenser, in particular for pasty material, comprising a head piece (20) which is attached to a fluid container (10) thus closing a filler opening (11) of said fluid container, and which comprises a pump chamber (29), characterized by a tubular chimney portion (21) which is provided on said head piece (20) and which projects from said head piece towards the fluid container (10), the volume of fluid displaced by said tubular chimney portion (21) when the head piece is advanced after airtight sealing of the filler opening (11) for moving said head piece (20) to an end position on the fluid container corresponding to the volume of a pump chamber (29).

7. A fluid dispenser according to claim 6, characterized in that an annular groove (25) for accommodating a container wall of the fluid container (10) is provided on the bottom side (22) of the head piece (20), said container wall surrounding the filler opening (11) and the groove depth of said annular groove (25) corresponding at least to the displacement distance (X) when seen in relation to the position of an upper edge (13) of the container wall of the fluid container (10) when the point of airtight sealing has been reached for the first time and an end position of the head piece (20) in the fully mounted condition of the dispenser.

8. A fluid dispenser according to claim 7, characterized in that, at the end position of the head piece (20), the upper edge (13) abuts on an axial stop means (26) provided on said annular groove (25).

* * * * *